US010815023B2

(12) United States Patent
Crouzet

(10) Patent No.: US 10,815,023 B2
(45) Date of Patent: Oct. 27, 2020

(54) PACKAGING COMPRISING A CASE AND A DRAWER, DRAWER FOR SUCH PACKAGING, AND BLANK FOR SUCH A DRAWER

(71) Applicant: FINEGA, Montelimar (FR)

(72) Inventor: Serge Crouzet, Chatel Saint Denis (CH)

(73) Assignee: FINEGA, Montelimar (FR)

( * ) Notice: Subject to any disclaimer, the term of this patent is extended or adjusted under 35 U.S.C. 154(b) by 0 days.

(21) Appl. No.: 16/312,420

(22) PCT Filed: Jun. 7, 2017

(86) PCT No.: PCT/FR2017/051432

§ 371 (c)(1),
(2) Date: Dec. 21, 2018

(87) PCT Pub. No.: WO2018/002465

PCT Pub. Date: Jan. 4, 2018

(65) Prior Publication Data

US 2019/0202592 A1 Jul. 4, 2019

(30) Foreign Application Priority Data

Jun. 28, 2016 (FR) ..... 16 56013

(51) Int. Cl.
*B65D 5/38* (2006.01)
*B65D 5/72* (2006.01)

(52) U.S. Cl.
CPC ..... *B65D 5/38* (2013.01); *B65D 5/728* (2013.01)

(58) Field of Classification Search
CPC ..... B65D 5/38; B65D 5/6688; B65D 5/728; B65D 85/1054; B65D 85/10
USPC ..... 229/129.1, 160.1, 125.08, 125.125, 229/125.37, 146, 87.13
See application file for complete search history.

(56) References Cited

U.S. PATENT DOCUMENTS 306,509 A * 10/1884 Munson ..... B65D 71/36 229/121
422,032 A * 2/1890 Munson ..... B65D 5/16 229/122

(Continued)

FOREIGN PATENT DOCUMENTS

CN 101511226 8/2009
DE 956 299 1/1957

(Continued)

*Primary Examiner* — Nathan J Newhouse
*Assistant Examiner* — Phillip D Schmidt
(74) *Attorney, Agent, or Firm* — Clark & Brody LP

(57) ABSTRACT

A packaging (14) includes a case (12) and a drawer (10). The drawer (10) has a rear wall (18) and two opposite lateral walls and further has an articulated upper portion and a lower portion. Upper and lower parts of the same lateral wall are disjointed to allow toggling of the upper portion of the drawer relative to the lower portion. At least one of the lower part and the upper part of each lateral wall has an extension (26*ap,* 26*bp*) which extends longitudinally towards the other part such that the extension (26*ap,* 26*bp*) extends parallel opposite the other part of the lateral wall for all configurations of the two portions of the drawer between an aligned configuration and a useful tilted configuration of the drawer.

9 Claims, 6 Drawing Sheets

(56) References Cited

U.S. PATENT DOCUMENTS

| | | | | |
|---|---|---|---|---|
| 2,956,722 | A * | 10/1960 | Prussack | B65D 5/6608 229/131 |
| 2004/0035722 | A1 | 2/2004 | Boriani et al. | |
| 2008/0142578 | A1 * | 6/2008 | Vickerstaff | B65D 5/728 229/125.37 |
| 2010/0282626 | A1 * | 11/2010 | Bertuzzi | B65D 5/4204 206/242 |
| 2012/0261285 | A1 * | 10/2012 | Holloway | B65D 85/1054 206/250 |

FOREIGN PATENT DOCUMENTS

| | | |
|---|---|---|
| DE | 25 44 743 | 4/1977 |
| EP | 0 189 618 | 8/1986 |
| WO | 2008/028812 | 3/2008 |

* cited by examiner

FIG.3
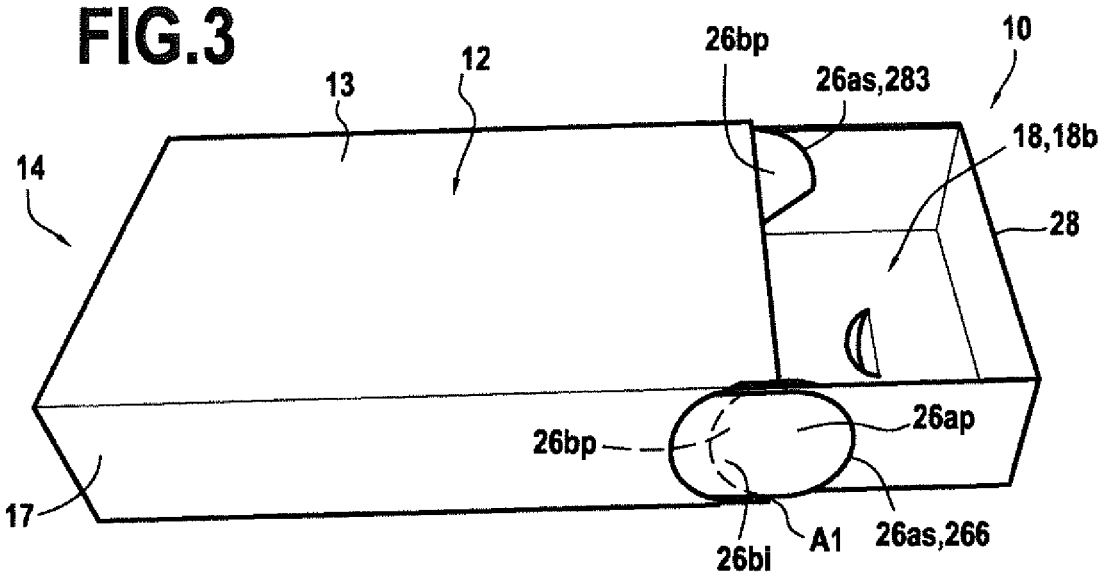
FIG.4A
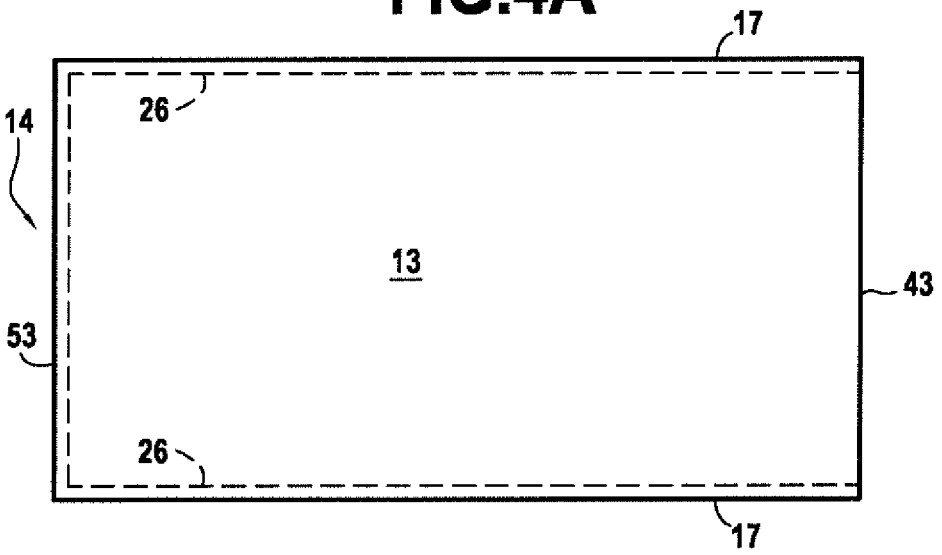
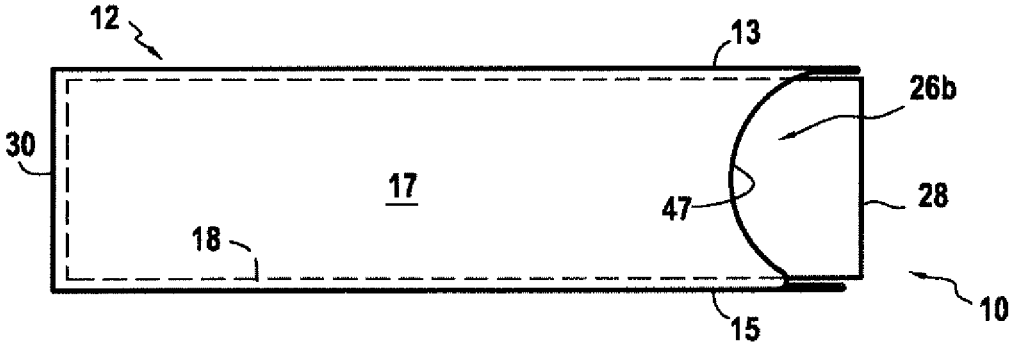
FIG.4B

FIG.6A
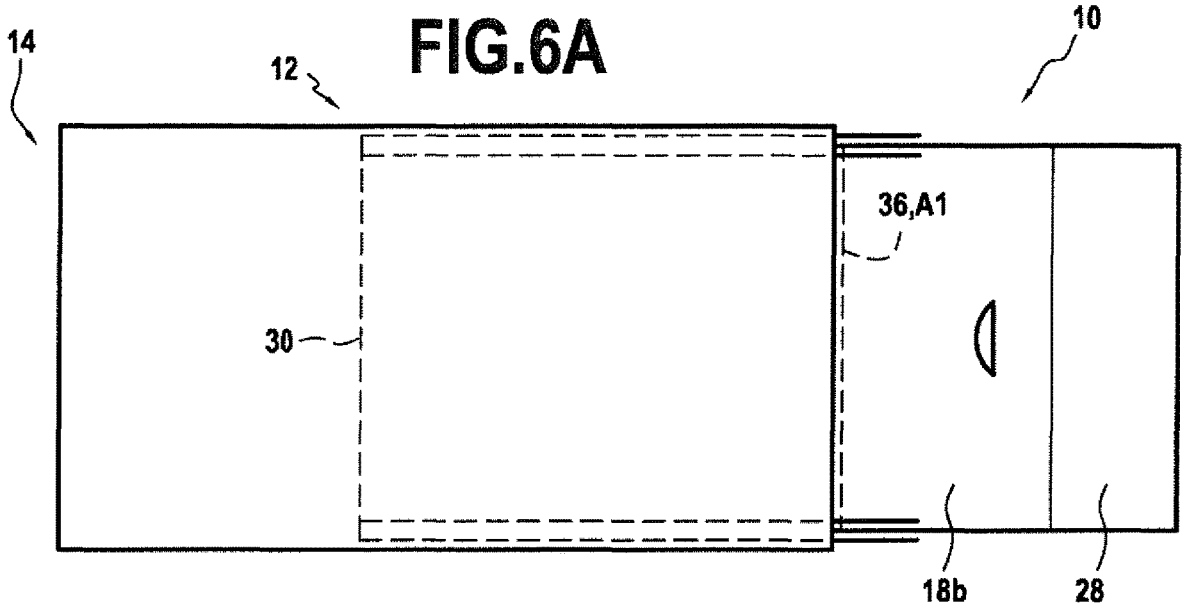
FIG.6B
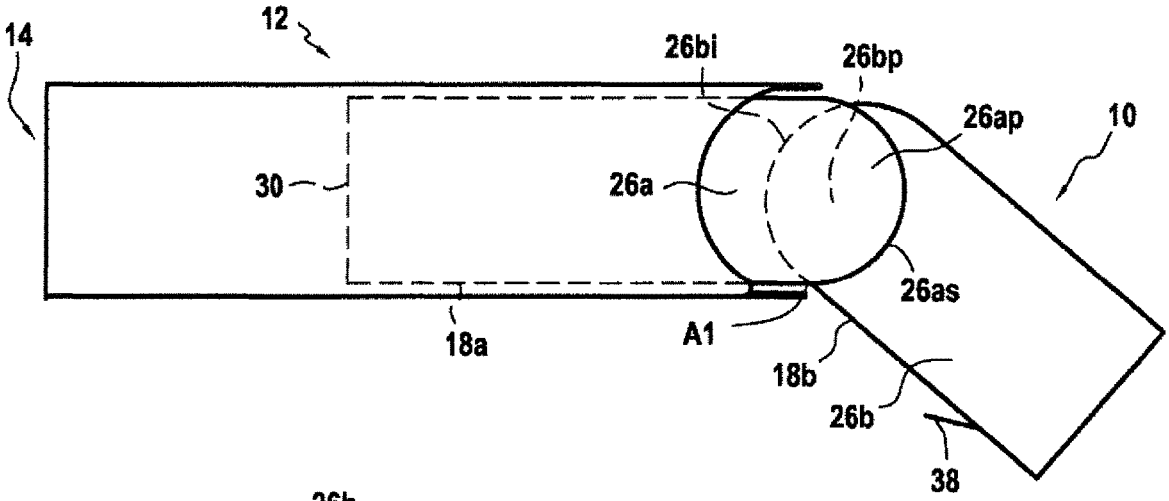
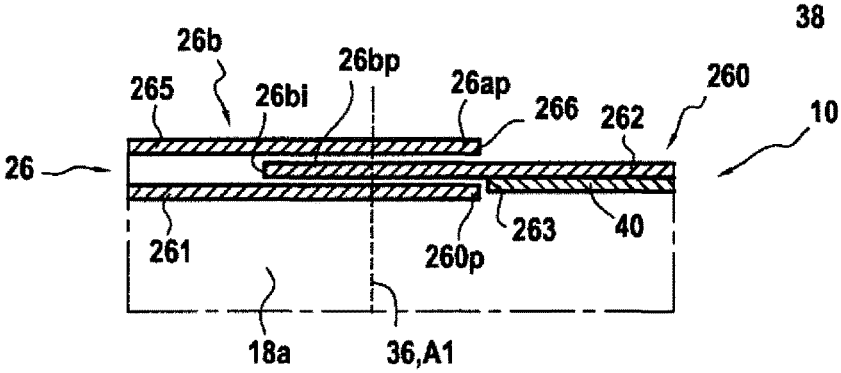
FIG.7

PACKAGING COMPRISING A CASE AND A DRAWER, DRAWER FOR SUCH PACKAGING, AND BLANK FOR SUCH A DRAWER

The invention relates to the field of packaging and more particularly the field of packaging obtained from a blank, pre-cut from a sheet of material, especially from a sheet of cardboard.

Such packaging is widely used in many fields for packing products. Packaging according to the invention is particularly adapted to the ordered packaging of elongated objects according to a longitudinal direction, especially packaging for cigars or cigarettes.

The packaging aimed by the invention is more particularly packaging comprising a case and a drawer, wherein:

- the case comprises four opposite panels in pairs and connected in pairs along four parallel longitudinal edges such that the case delimits an internal space which extends longitudinally and which has a closed quadrilateral transversal cross-section;
- the case is open at at least one upper longitudinal end;
- the drawer has a transversal cross-section complementary to that of the internal space of the case so it can be guided sliding longitudinally inside the case between at least one retracted position and an extended position.

In this type of packaging in two pieces, the drawer is intended to contain the products to be packed but is generally not fully closed. In particular, it can have an opening in the region of a front face to allow access to the products contained in the drawer. The case, inside which the drawer is intended to be at least in part received in its retracted position, closes off the front opening of the drawer when the drawer is in retracted position inside the case, preventing access to the products and preventing said products from escaping from the packaging formed of two pieces. To access the products, the drawer therefore has to be slid to its extended position to clear the front opening. A typical example of such a type of product is the packaging of matches in two pieces. In its simplest version the drawer generally has a rear wall, and two opposite lateral walls and two opposite transversal walls which are perpendicular to the base. The drawer is therefore open towards the front only, according to a direction perpendicular to the rear wall, but it is open over its entire surface corresponding to the rear wall. The case with four panels has a transversal cross-section corresponding to that of the drawer, and vice versa. It can be open at its two longitudinal ends to allow the entry and exit of the drawer in one direction or the other. To access the matches contained in such packaging, the drawer therefore has to be slid relative to the case to allow access to the front opening of the drawer. In the event where the matches are in ordered rows, parallel to each other, in the box, to take out a match it is necessary to open the access widely by having the drawer slide over a long distance, as far as an extended position in which the drawer is almost fully removed from the case. In fact, on the one hand the upper transversal wall of the drawer prevents the matches from coming out according to a longitudinal direction and on the other hand, especially when the packaging is full or almost full, the upper transversal edge of the front panel of the case prevents a match from tilting to the front as long as this almost fully extended position has not been reached. This is problematic to the extent where it is frequent for the drawer to exit fully from the case, with reinsertion which is not always easy. Also, the matches are then no longer held in and can easily fall out of the drawer via the front face.

An advanced example of packaging comprising a case and a sliding drawer is described in document EP-0.189.618-A1. This packaging is provided for elongated cosmetics sticks according to a longitudinal direction and at a longitudinal end having a head bearing the cosmetic product.

In this packaging, the drawer comprises a rear wall delimited transversally by rear longitudinal edges, opposite, and comprises two opposite lateral walls extending perpendicularly to the rear wall, each respectively along one of the rear longitudinal edges of the rear wall. More particularly, the drawer comprises an upper portion, comprising an upper part of the rear wall and upper parts of the two lateral walls, and a lower portion, comprising a lower part of the rear wall and lower parts of the two lateral walls. The lower portion and the upper portion of the drawer are articulated to each other via an articulation which has a transversal articulation axis and which connects the upper and lower parts of the rear wall. It is evident that the upper and lower parts of the lateral walls of the drawer are disjointed to allow toggling of the upper portion of the drawer relative to the lower portion of the drawer around the transversal articulation axis. This toggling occurs between an aligned configuration, in which the lower part and the upper part of the rear wall are coplanar, and at least one useful tilted configuration in which the lower part and the upper part of the rear wall form an angle. The technical effect achieved by toggling of the upper portion of the drawer, as soon as toggling is sufficient, is to remove an elongated product, in this case a cosmetic stick, by sliding essentially according to the longitudinal direction. It is clear in fact that toggling allows the upper transversal wall of the drawer to be at least partially disengaged from the longitudinal direction via which a product is to be extracted.

In the packaging illustrated in the document EP-0.189.618-A1, each lateral wall of the drawer has a cut-out between the lower part and the upper part of the lateral wall. This cut-out materialises by the presence, when the upper portion of the drawer is tilted towards the rear, of two free end edges of these respective parts of lateral walls.

In use, it appears that these free edges, especially the one which delimits the lower end of the upper part of the lateral wall, can cause problems.

First of all, when the drawer is brought back by sliding from its extended position towards its retracted position inside the case, this free edge can interfere with an upper edge of the case and cause jamming which impairs the closing operation. To the extent where the lateral wall of the drawer is generally made of cardboard, this jamming can cause folding or even tearing, which is likely to compromise all subsequent handling of the packaging.

Also, when the upper part of the drawer is tilted repeatedly between the aligned and tilted configurations, this free edge is likely to rub against the products contained in the drawer. When the latter are fragile, the free edge can scrape the products and damage them.

The aim of the invention therefore is to propose advanced packaging which resolves at least one of these problems. With this aim, the invention proposes a drawer for packaging comprising a case and a drawer, the drawer being obtained from at least one pre-cut blank from a sheet of material, of the type wherein:

- the drawer comprises a rear wall delimited transversally by opposite rear longitudinal edges and two opposite lateral walls extending perpendicularly to the rear wall, each respectively along one of the rear longitudinal edges of the rear wall;

the drawer comprises an upper portion, comprising an upper part of the rear wall and upper parts of the two lateral walls, and a lower portion, comprising a lower part of the rear wall and lower parts of the two lateral walls;

the lower portion and the upper portion of the drawer are articulated to each other by an articulation which has a transversal articulation axis and which connects the lower part and the lower part of the rear wall, the lower part and the upper part of the same lateral wall of the drawer being disjointed to allow toggling of the upper portion of the drawer relative to the lower portion of the drawer around the transversal articulation axis between an aligned configuration in which the lower part and the upper part of the rear wall are coplanar, and at least one useful tilted configuration in which the lower part and the upper part of the rear wall form a non zero angle;

characterized in that at least one of the lower part and the upper part of each lateral wall has an extension which extends longitudinally towards the other part beyond the transversal articulation axis such that the extension extends parallel opposite the other part of the lateral wall for all configurations of the two portions of the drawer between the aligned configuration and the useful tilted configuration of the drawer.

According to other optional characteristics of a drawer according to the invention, taken singly or in combination:

For a relevant lateral wall, in the region of the extension opposite, the upper part of the lateral wall can be arranged transversally towards the exterior of the drawer relative to the lower part of the relevant lateral wall.

For a relevant lateral wall, the lower part and the upper part can each comprise an extension which extends longitudinally towards the other part beyond the transversal articulation axis such that the extensions of the two parts extend parallel opposite each other for all configurations of the two portions of the drawer between the aligned configuration and the useful tilted configuration of the drawer.

For a relevant lateral wall, the lower part of the lateral wall can have a structure having two parallel panels, respectively internal and external, and at least one lower end of the upper part of the lateral wall can be received with the possibility of sliding between the internal panel and the external panel of the lower part for all configurations of the two portions of the drawer between the aligned configuration and the useful tilted configuration of the drawer.

For a relevant lateral wall, the two parallel panels of the lower part of the lateral wall are each fitted with an extension which extends longitudinally towards the upper part beyond the transversal articulation axis, and, for said relevant lateral wall, the upper part of the lateral wall comprises an extension which is received with possibility of sliding between the extensions of the two internal and external panels of the lower part of the lateral wall for all the configurations of the two portions of the drawer between the aligned configuration and the useful tilted configuration of the drawer.

For at least one of the two lateral walls, the upper part of the lateral wall can have an excess thickness delimited downwards by a lower edge which, in aligned configuration of the two portions of the drawer, comes to stop against an upper edge of the lower part of the relevant lateral wall.

The drawer can comprise an upper wall which can extend perpendicularly to the longitudinal direction in the region of an upper transversal edge of the upper part of the rear wall of the drawer.

The drawer can comprise a front wall which is connected to longitudinal front edges of the lower part of each of the lateral walls.

The drawer can be made in a single piece from a single blank of cardboard whereof the grammage is greater than or equal to 180 g/m2, and less than or equal to 2000 g/m2.

The invention also relates to packaging comprising a case and a drawer, of the type wherein:

the case comprises four panels opposite in pairs and connected in pairs along four parallel longitudinal edges such that the case delimits an internal space which extends longitudinally and which has a closed quadrilateral transversal cross-section;

the case is open at at least one upper longitudinal end;

the drawer has a transversal cross-section complementary to that of the internal space of the case so it can be guided sliding longitudinally inside the case between at least one retracted position and an extended position;

characterized in that the drawer has one of the preceding characteristics.

The invention further relates to a pre-cut blank for forming a drawer of packaging, formed in a single piece from a sheet of material, of the type comprising:

a rear panel delimited transversally by opposite longitudinal edges, the rear panel comprising an upper part and a lower part articulated to each other along a pre-marked transversal fold line;

two first lower lateral panels each articulated respectively, by a pre-marked longitudinal fold line, to one of the two opposite longitudinal edges of the lower part of the rear panel;

an upper transversal panel which is articulated, by a pre-marked fold line, to an upper transversal edge of the upper part of the rear panel and which is delimited transversally by two longitudinal edges;

two upper lateral panels which are each articulated respectively, by a pre-marked longitudinal fold line, to one of the two opposite longitudinal edges of the upper transversal panel;

characterized in that the upper lateral panels exhibit a dimension according to the transversal direction which is greater than the longitudinal dimension of the upper part of the rear panel and/or the first lower lateral panels extend longitudinally towards the upper part of the rear panel beyond the pre-marked transversal articulation fold line between the two parts of the rear panel.

According to other optional characteristics of a blank according to the invention, taken singly or in combination:

the blank can comprise two lateral flaps each articulated respectively, by a pre-marked longitudinal fold line, to one of the two opposite longitudinal edges of the upper part of the rear panel.

The first lower lateral panels are separated from the lateral flaps by a cut-out line which longitudinally overruns beyond the level of the pre-marked transversal articulation fold line between the two parts of the rear panel.

The blank can comprise two second lower lateral panels each articulated respectively, by a pre-marked longitudinal fold line, to a lower transversal edge of one of the first lower lateral panels.

The second lower lateral panels can exhibit a dimension according to the longitudinal direction which is greater than the longitudinal dimension of the lower part of the rear panel.

Various other characteristics will emerge from the description given below in reference to the appended drawings which show, by way of non-limiting examples, embodiments of the object of the invention.

FIG. 3 is a perspective view of packaging in two pieces according to the invention comprising a case and a drawer received to slide in the case.

FIGS. 4A and 4B illustrate respectively in front and side elevation the packaging of FIG. 3 in retracted position of the drawer in the case.

FIGS. 6A and 6B illustrate respectively in front and side elevation the packaging of FIG. 3 in extended position of the drawer, the upper portion of the drawer being in tilted configuration.

FIG. 7 is a sectional view, via a plane parallel to the rear wall, showing the covering of the upper and lower parts of a lateral wall of an embodiment of a drawer according to the invention.

Figure 2A:
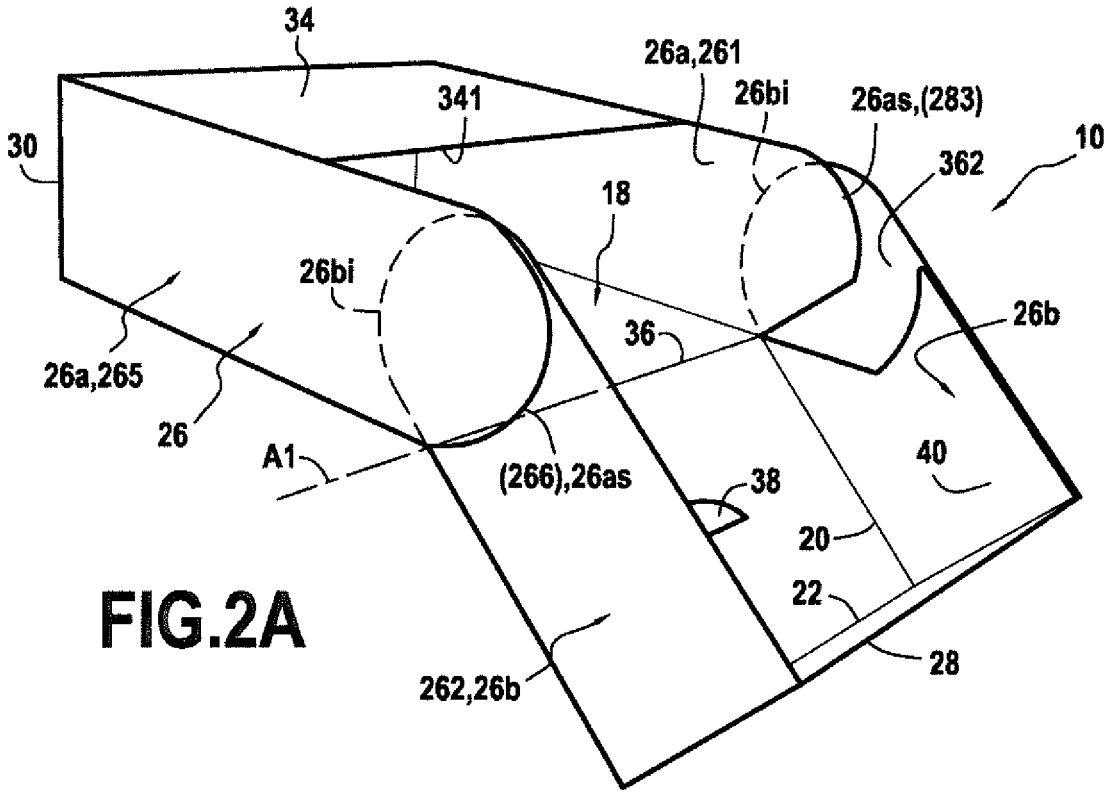
FIGS. 2A and 2B illustrate respectively in perspective a drawer and a case made by starting out from a pre-cut side such as illustrated respectively in FIGS. 1A and 1B.
Figure 2B:
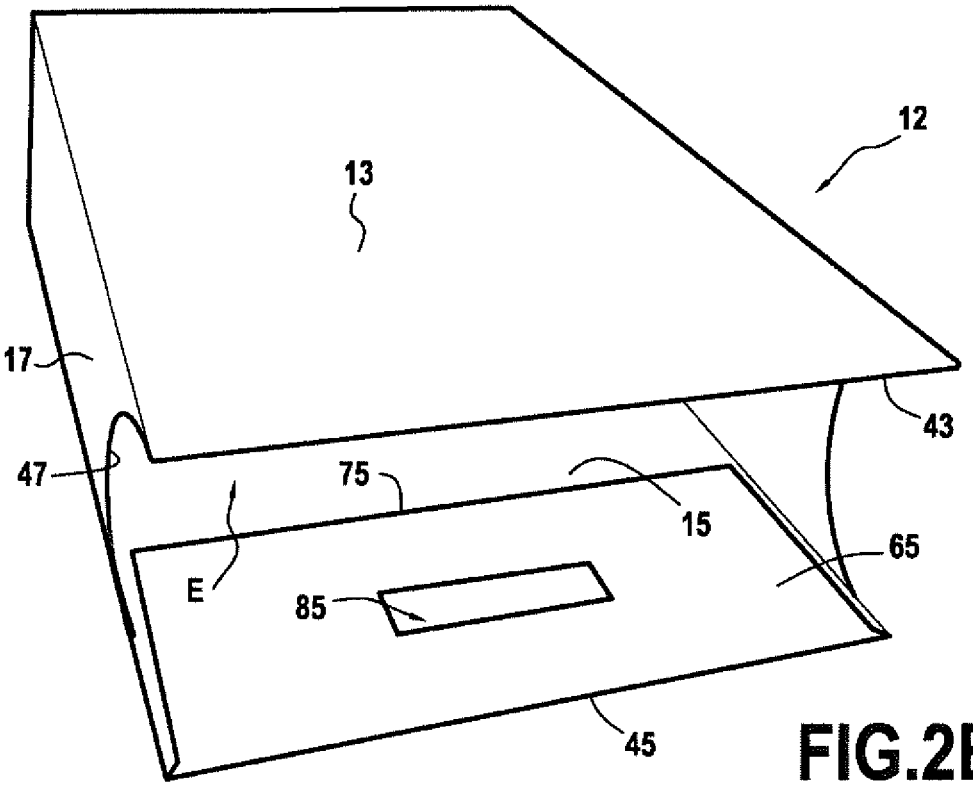

FIGS. 2A, 2B and 3 illustrate respectively a drawer 10, a case 12, and packaging 14 composed of this drawer 10 and this case 12 wherein the drawer 10 is received and guided to slide according to a longitudinal direction inside the case 12.

Figure 1A:
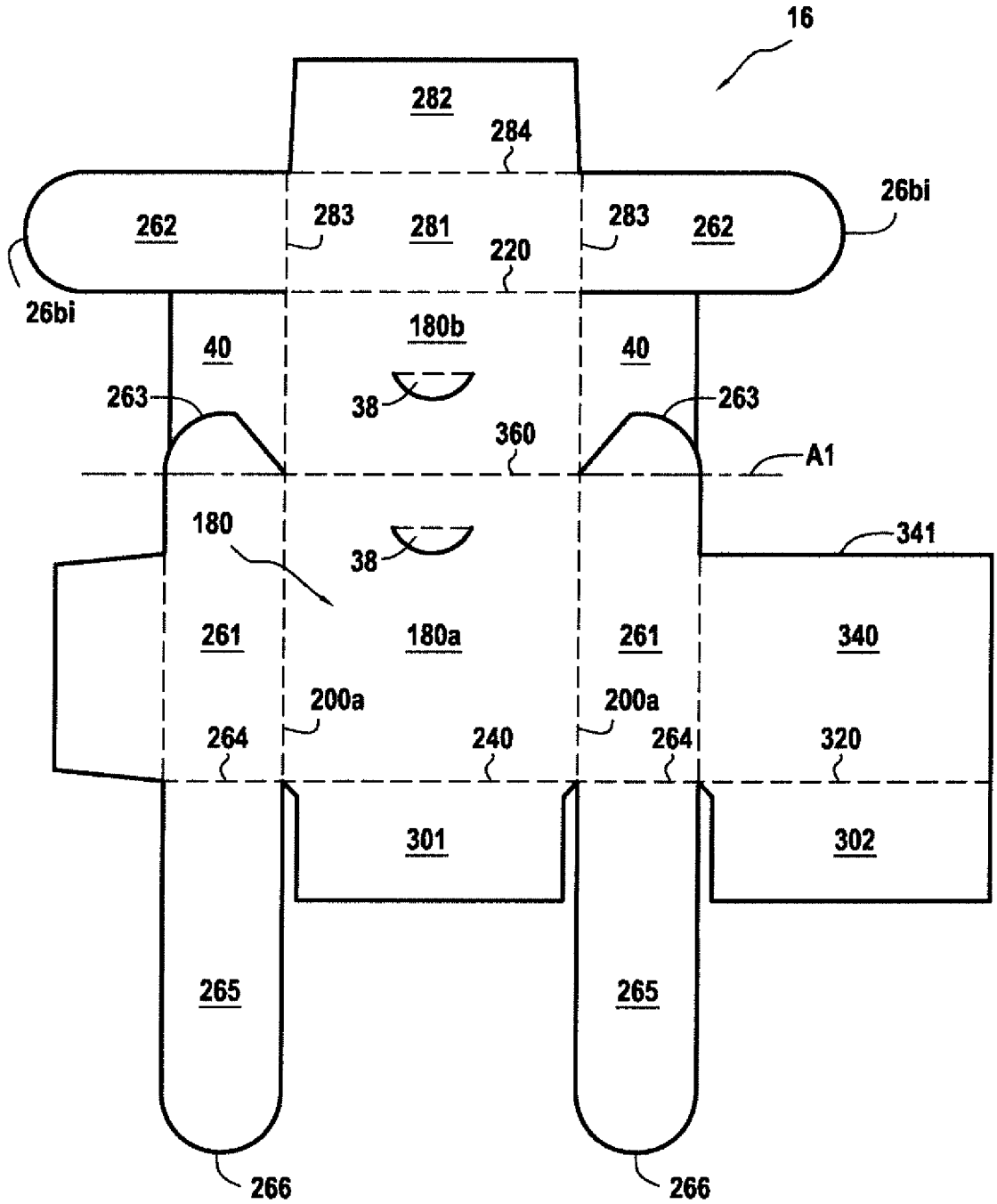
FIG. 1A is a plan view of an embodiment of a pre-cut blank intended to form a drawer of packaging in accordance with the ideas of the invention.

The drawer 10 is likely to be made from at least one pre-cut side 16 such as illustrated in FIG. 1A. The drawer 10 could be made by assembling several blanks. However, advantageously, the drawer 10 is made from a single side. The blank 16 which is illustrated in FIG. 1A is made by cutting out a sheet of material and constitutes a single blank in that there is continuity of material in the blank, which is not constituted by an assembly of several previously disjointed elements.

Figure 1B:
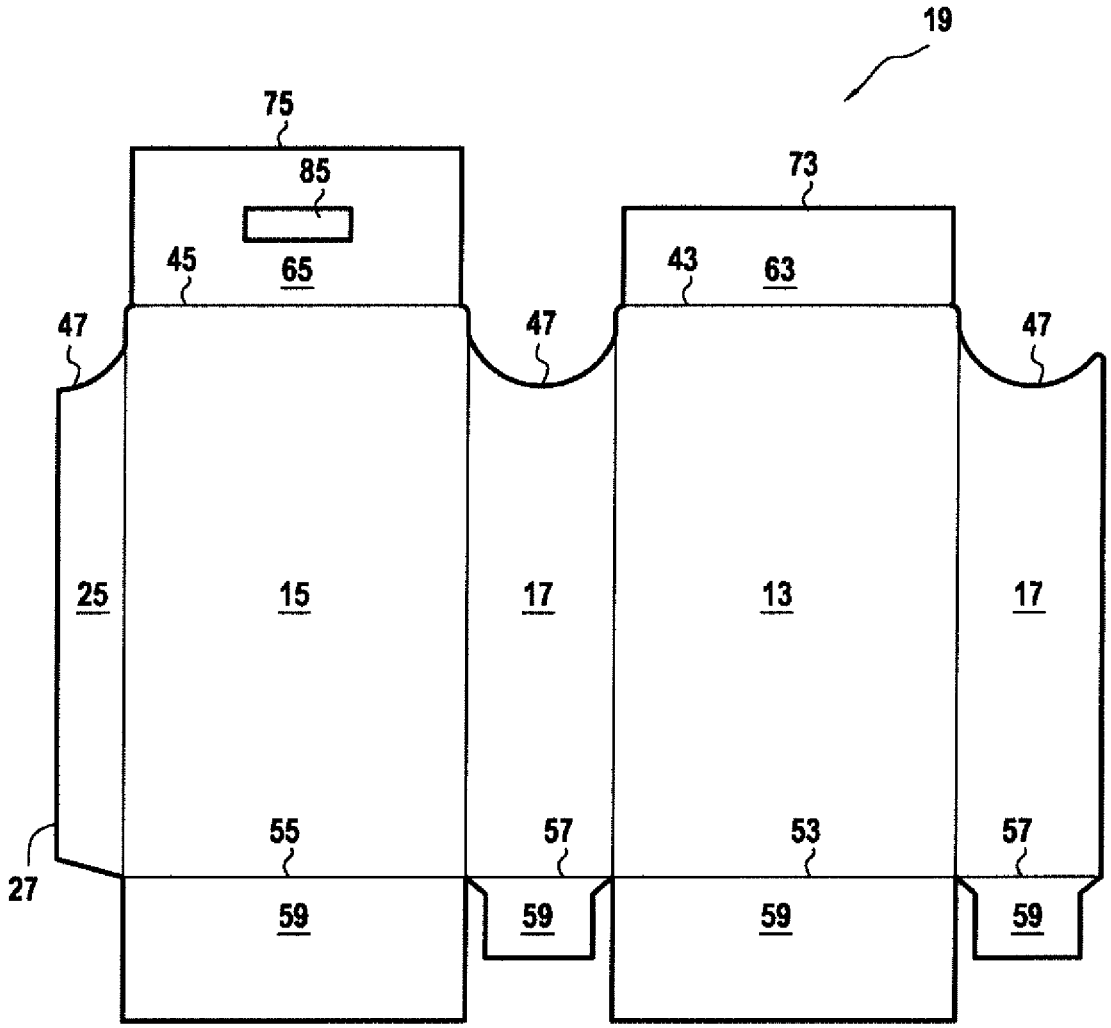
FIG. 1B is a plan view of an embodiment of a pre-cut blank intended to form a case of packaging compatible with the drawer likely to be made by way of the blank of FIG. 1A.

Advantageously, the case 12 is also likely to be made from at least one pre-cut blank 17 such as illustrated in FIG. 1B. It is evident however that the case could be constituted variously, for example by moulding of plastic material.

The material of the blank, for the drawer 10 and/or for the case 12, will preferably be a conventional material for this type of packaging. It can for example be cardboard, which can for example have grammage greater than or equal to 180 g per square meter. Generally, the cardboard used for such packaging has grammage of less than or equal to 2000 g per square meter. It has seemed that grammages between 220 and 350 grams per square meter are particularly advantageous. But, the use of other materials, including polymer materials, is possible. Preferably, these materials have a semi-rigid flexural appearance around an axis in the plane of the sheet in which the blank is pre-cut. Different materials can be used for the case 12 on the one hand and for the drawer 10 on the other hand.

FIGS. 1A and 1B illustrate in solid lines the free or cut-out edges of the blank. Dotted lines illustrate the markings made in the material of the blank but in the region of which the blank is not entirely cut out. Making the markings can involve one or more techniques, examples of which can be:

- the kiss-cutting technique, in which the sheet of material is cut out, but not over its entire thickness;
- a cut-out on a part only of the thickness of the line, for example a cut-out according to dotted lines;
- marking by crushing of material (fluting), etc. . . . .

These markings are intended to form a pre-marked fold line of the sheet of material prior to manufacturing of the packaging. In fact, the blank, which is flat, must be subjected to folding and assembly operations, especially by adhesion, to create a three-dimensional packaging element.

The drawer 10 comprises a rear wall 18 delimited transversally by two opposite rear longitudinal edges 20 and by two transversal edges, respectively upper 22 and lower 24. The rear wall 18 is therefore rectangular. In the example illustrated, this rear wall 18 is formed by a corresponding rear panel 180 of the blank 16 which is delimited transversally by opposite longitudinal edges 200.

The packaging 14 arbitrarily has a longitudinal dimension, a transversal dimension perpendicular to the longitudinal dimension but parallel to the rear wall 18, and a direction of thickness perpendicular to the rear wall 18.

The drawer 10 comprises two opposite lateral walls 26 extending perpendicularly to the rear wall 18, each respectively along one of the rear longitudinal edges 20 of the rear wall 18. The detail of the construction of these opposite lateral walls 26 will be described later.

In some embodiments, the drawer 10 comprises another upper transversal wall 28 which extends perpendicularly to the longitudinal direction in the region of the upper transversal edge 22 of the rear wall of the drawer. In the embodiment illustrated, this upper transversal wall 28 is formed by an upper transversal panel 281 of the blank 16 which is articulated, by a pre-marked fold line, to an upper transversal edge 220 of the rear panel 180 which corresponds to the upper transversal edge 22 of the rear wall 10. The upper transversal panel 281 is delimited transversally by two longitudinal edges 283.

By way of example, the upper transversal wall 28 can comprise an upper transversal flap 282 which is adhered against an internal face of the upper transversal panel 281. For example, in the blank 16, the upper transversal flap 281 can be articulated, by a pre-marked fold line, to an upper transversal edge 284 of the upper transversal panel 281, so it can be folded up against the internal face of the upper transversal panel 281 at the time of the three-dimensional forming of the drawer 10. This flap 282 especially reinforces the upper transversal wall 28. The upper transversal wall 28 has for example a dimension according to the thickness, perpendicularly to the rear wall 18, equal to that of the lateral walls 26. In closed position, it will be seen that this upper transversal wall 28 forms a blockage of the upper longitudinal end of the packaging when the drawer is received in retracted position in the case.

In some embodiments the drawer 10 comprises another lower transversal wall 30 which extends perpendicularly to the longitudinal direction in the region of the lower transversal edge 24 of the rear wall 18 of the drawer. The lower transversal wall 30 has for example a dimension, according to the thickness, perpendicularly to the rear wall 10, equal to that of the lateral walls 26. This lower transversal wall 30 forms a lower limit to the volume delimited by the drawer 10. Also, when the drawer is shifted by sliding longitudinally relative to the case 12, upwards, the lower transversal wall 30 ensures that the objects contained in the drawer follow the longitudinal sliding movement of the drawer 10 relative to the case 12.

As in the illustrated embodiment, this lower transversal wall 30 can be formed by a first lower transversal flap 301 of the blank 16 which is articulated, by a pre-marked fold line, to a lower transversal edge 240 of the rear panel 180, and by a second transversal flap 302 which is articulated, by a pre-marked fold line, to a lower transversal edge 320 of a front panel 340 which, in the embodiment of the drawer illustrated, is intended to form a front wall 34 of the drawer 10. After the three-dimensional forming of the drawer 10, the front wall 34 is connected to longitudinal front edges of the lower part 26*a* of each of the lateral walls 26, for one by a pre-marked fold line and for the other by a flap assembly solid with said other lower part 26*a* of lateral wall 26. During the three-dimensional forming of the drawer 10, the two flaps 301, 302, each articulated in the region of two edges which, in the formed drawer 10, are parallel and opposite, can be folded up and adhered to each other to form the lower transversal wall 30.

In the present text, the terms "lower" and "upper" or "top" and "bottom" designate two opposite orientations along the longitudinal direction, but they are completely arbitrary relative to orientation of the packaging in space. Similarly, the notions "front" and "rear" designate two opposite orientations along the direction of the thickness, but they are completely arbitrary relative to orientation of the packaging in space. These notions involve no preferred orientation of the packaging in space.

As seen in FIG. 3, the case 12 can for example comprise four panels opposite in pairs, and connected in pairs along four parallel longitudinal edges. The case 12 can comprise a front panel 13 and an opposite rear panel 15, and two lateral panels 17. Each lateral panel 17 is attached on the one hand to a longitudinal edge front of the front panel 13 and on the other hand to a longitudinal edge rear of the rear panel 15. Between these four panels, the case 12 delimits an internal space E which extends longitudinally and which has a closed quadrilateral transversal cross-section. In general, this transversal cross-section formed by the four front 13, rear 15 and lateral 17 panels is a section rectangular or square.

The case 12 is open at at least one longitudinal end, which will be qualified here arbitrarily as upper longitudinal end. In the example illustrated, it is preferably provided that the other opposite longitudinal end, here lower, is closed by a lower transversal wall.

FIG. 1B shows an example of a single pre-cut blank 19, also made of cardboard, which creates the case of FIG. 2B. The blank comprises the four front 13, rear 15 and lateral 17 panels which are juxtaposed and articulated successively to each other around three parallel longitudinal folding lines 21. The folding lines 21 therefore define longitudinal edges of the case.

One of the panels, in case the rear panel 15, also comprises a longitudinal edge 23 by which it is connected to an assembly flap 25, the longitudinal edge 23 corresponding to a folding line, preferably pre-marked, between the rear panel 15 and the flap 25. Opposite the longitudinal side 23, the flap 25 comprises a free longitudinal edge 27, which is a free edge of the blank 19.

Each of the four panels 13, 15, 17 has upper 43, 45, 47 and lower 53, 55, 57 edges which are arranged at the longitudinal ends of the corresponding panel. In the proposed example, the front 13 and rear 15 panels exhibit the same dimension according to the longitudinal direction such that their respective upper 43, 45 and lower 53, 55 transversal edges are respectively aligned according to an upper transversal line and according to a lower transversal line. However, the panels lateral 17 have an upper edge 47 which is retracted longitudinally downwards relative to the upper transversal edges 43, 45 of the front 13 and rear 15 panels. When the drawer 10 is received in retracted position in the case, this retraction, or detaching, grips the end upper of the drawer to draw it longitudinally towards its extended position.

It is understood that the four front 13, rear 15 and lateral 17 panels of the case 12 are intended to form, after folding at 90° around each of the folding lines 21, 23, a main envelope closed back on itself defining a closed contour around an internal space E (seen more particularly in FIG. 3). It is also understood that the flap 25 can also be folded back at 90° around the folding line 23 so it can be brought to rest, plane against plane, against the opposite lateral panel 17. Assembly of the flap 25 on the lateral panel 17, for example by adhesion, fixes the three-dimensional geometry of the case. The fact that the case defines a closed contour does not oppose the fact that its panels 13, 15, 17 optionally have windows or openings.

Preferably, the drawer 10 has a transversal cross-section complementary to that of the internal space E delimited by the four panels of the case so it can be guided by sliding longitudinally inside the case between at least one retracted position and an extended position.

In the example illustrated, at its lower longitudinal end, the case 12 has four closure flaps 59 for closing the packaging at this opposite longitudinal end. Each closure laps 59 is articulated along the lower transversal edge 53, 55, 57 of one of the panels 13, 15, 17, which are here aligned transversally. The flaps 59 are intended to be folded back on each other and be assembled, for example by adhesion in pairs, to form a lower transversal wall which closes the lower end of the case 12. In the example illustrated, the retracted position of the drawer corresponds to the stopping of the drawer 10 against the lower transversal wall of the case 12.

In the example illustrated, the drawer 10 and the case 12 exhibit the same longitudinal dimension such that, in retracted position, the upper transversal wall 28 of the drawer 10 is at the same level as the upper edges 43, 45 of the front and rear panels of the case 12.

In the example illustrated, the front panel 13 has a front upper flap 63, which is intended to be assembled flat against the front panel 13, for example by adhesion, in the region of the upper edge 43 of the front panel. In the blank 19, the upper flap is for example connected to the upper edge of the front panel 13 by a pre-marked fold line allowing it to turn down at 180° against an internal face of the front panel. Folded up and adhered in this way, the front upper flap 63 reinforces the case at this level. But in the example illustrated, the transversal end edge 73 of the front upper flap 63 is also provided to cooperate with an upper transversal edge 341 of the front face of the drawer 10 to form a stop limiting the possibility of extracting the drawer 10 upwards. This stop system defines the extended position of the drawer 10 relative to the case 12.

In the example illustrated, the rear panel 15 has a rear upper flap 65, which is intended to be assembled flat against the rear panel, for example by adhesion, in the region of the upper edge 45 of the rear panel 15. In the blank 19, the rear upper flap 65 is for example connected to the upper edge 45 of the rear panel 15 by a pre-marked fold line allowing it to turn down at 180° against an internal face of the rear panel 15. Folded up and adhered in this way, the rear upper flap 65 reinforces the case at this level. The rear upper flap 65 comprises a transversal end edge 75 and, substantially in its centre, a window 85 which is delimited longitudinally by two transversal edges. The transversal end edge 75 and the window 85 of the rear upper flap 65 are intended to cooperate with elastic tabs 38 set in the rear wall 18 of the drawer 10. Each elastic tab 38 is formed for example by a cut-out in an arc of a circle in the rear wall 18. Each cut-out in an arc of a circle has ends aligned according to a transversal line such that the tab 38 delimited by the cut-out can pivot relative to the plane of the rear wall 18 of the drawer about a transversal pivoting axis corresponding to this line. At the time of installation these tabs are pre-deformed by having them tilt towards the rear relative to the rear wall 18 of the drawer such that the tabs come to rest against the rear panel 15 and or the upper flap 65 of the case 12. Therefore, when the drawer 10 is shifted longitudinally relative to the case 12, between the retracted position and the extended position, the tabs 38 are likely to cooperate with the transversal edges of the window 85 and with the lower edge 75 of the rear upper flap 65 of the case 12. Due to the relative position of the tabs and these transversal edges, each tab can, in one of the directions of displacement, undergo reversal by pivoting around its pivot axis, or in the opposite direction of displacement can strike the rear panel 15 of the case by elastic relaxation to emit a sound. The presence of the two tabs 38, the window 85 and the transversal end edge 75 therefore generate noises, of type snapping, throughout displacement of the drawer 10 between its entry position and its extended position relative to the case 12. In particular, with the illustrated arrangement, the packaging emits a snapping sound when, in the direction of opening, the drawer 10 arrives in extended position. Advantageously, this snapping can coincide with the stopping of the upper edge 341 of the front face 34 of the drawer 10 against the transversal end edge 73 of the front upper flap of the case 12. With the illustrated arrangement, the packaging emits two snapping sounds offset over time during the closing trajectory of the drawer 10 between the extended position and the retracted position. Advantageously, the second of these two snapping sounds can correspond to arrival of the drawer 10 in retracted position.

The drawer 10 comprises a lower portion and an upper portion which are articulated to each other by an articulation 36 which has a transversal articulation axis A1. This articulation 36 is advantageously formed by a pre-marked fold line 360 which extends transversally in the rear panel 180 of the blank 16. The articulation 36 divides the rear wall 18 into two parts 18*a*, 18*b*, connected by the articulation, such that the folding line 360 divides the rear panel 180 into two parts: a lower part 180*a* and an upper part 180*b*.

The lower portion of the drawer 10 comprises the lower part 18*a* of the rear wall 18 and comprises lower parts 26*a* of the two lateral walls 26.

The upper portion of the drawer 10 comprises the upper part 18*b* of the rear wall 18 and comprises lower parts 26*a* of the two lateral walls 26.

Figure 5A:
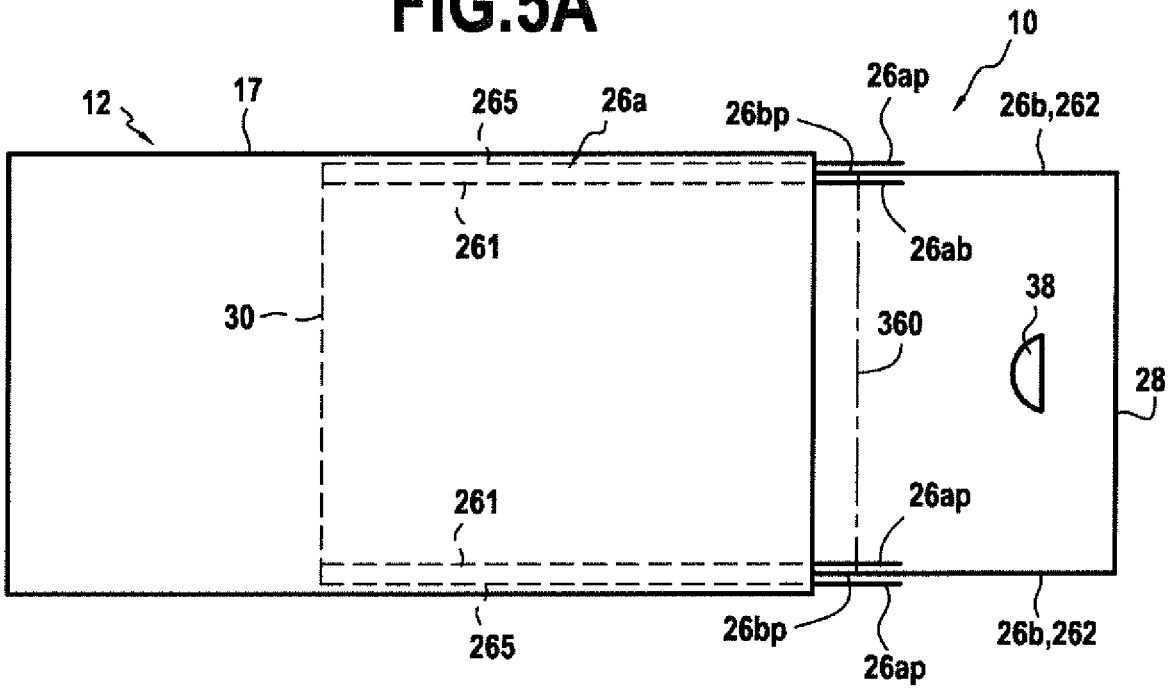
FIGS. 5A and 5B illustrate respectively in front and side elevation the packaging of FIG. 3 in extended position of the drawer, the upper portion of the drawer being in aligned configuration.
Figure 5B:
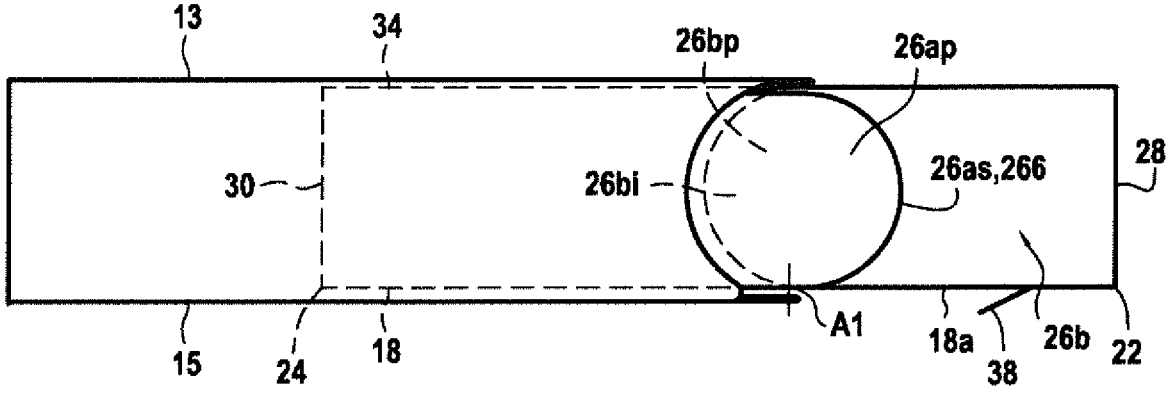

The lower 26*a* and upper 26*b* parts of the lateral walls 26 of the drawer are disjointed to allow toggling of the upper portion of the drawer relative to the lower portion of the drawer around the transversal articulation axis A1 between an aligned configuration, illustrated for example in FIGS. 5A and 5B, in which the lower part 18*a* and the upper part 18*b* of rear wall 18 are coplanar, and at least one useful tilted configuration in which the lower part 18*a* and the upper part 18*b* of rear wall 18 form an angle. In other terms, the lower 26*a* and upper 26*b* parts of each lateral wall 26 are mobile relative to each other in rotation around the axis A1 of the articulation 36.

Advantageously, at least one of the lower part 26*a* and the upper part 26*b* of each of the two lateral walls 26 comprises an extension 26*ap*, 26*bp* which extends longitudinally towards the other part beyond the transversal articulation axis A1, such that the extension extends parallel opposite, therefore covering, the other part of the lateral wall for all configurations of the two portions of the drawer between the aligned configuration and the useful tilted configuration of the drawer 10.

The upper part 26*b* of lateral wall 26 has a lower edge 26*bi* which extends according to the thickness of the drawer. In the example illustrated, this lower edge 26*bi* has a convex geometry in an arc of a circle centred at mid-thickness of the lateral wall, longitudinally in the region of the axis of articulation A1. In the same way, the lower part 26*a* of a lateral wall 26 has an upper edge 26*as* which extends according to the thickness of the drawer. In the example illustrated, this upper edge 26*as* has a convex geometry in an arc of a circle centred at mid-thickness of the lateral wall, longitudinally in the region of the axis of articulation A1. To obtain covering, it is therefore advantageously provided that the upper edge 26*as* of the lower part 26*a* extends longitudinally at least in part above the lower edge 26*bi* of the upper part 26*b* of the relevant lateral wall 26, or vice versa.

It could be provided that only one of the two lower 26*a* and upper 26*b* parts of a lateral wall 26 comprises such an extension 26*ap* or 26*bp* beyond the axis of articulation A1.

However, in the example illustrated, the two lower 26*a* and upper 26*b* parts of the same lateral wall respectively comprise such an extension 26*ap* and 26*bp* which extends longitudinally beyond the axis of articulation A1, one downwards and the other upwards. In this way, the surfaces covering the two lower 26*a* and upper 26*b* parts are distributed on each side longitudinally relatively in the region of the axis of articulation A1.

It is evident that it is considered as a useful configuration of the drawer 10 a configuration in which the upper part 18*b* of the drawer 10 is tilted towards the rear, relative to the plane of the lower part 18*a* of the rear wall of the drawer, at a non-zero angle sufficient to make for easy extraction of a product contained in the packaging according to a longitudinal direction. In useful tilted configuration, this angle is preferably at least 10°, more preferably at least 20°. In most applications, this angle does not need to be over 45°, or even does not need to be over 30°.

In the embodiment illustrated in FIG. 6A, the drawer 10 has a useful tilted configuration characterized by a toggling angle of 40° towards the rear of the upper portion of the drawer. It is clear that, in this arrangement, and given the respective geometry of the different elements of the drawer, a front edge of the upper transversal wall 28 of the drawer is offset towards the rear relative to the plane of the lower part 18*a* of the rear wall of the drawer. In the example illustrated, the edge front of the upper transversal wall 28 is formed by the upper transversal edge 284 of the upper transversal panel 281. Tilted in this way, the upper transversal wall 28 of the drawer is no longer likely to form an obstacle to extraction, according to a longitudinal direction, of a product from the volume defined by the drawer 10. Therefore, even in the case of packaging entirely filled with products, it is possible to extract a product without subjecting it to flexural constraint. This is particularly advantageous for fragile products such as cigars or cigarettes.

By way of the covering characteristic of the two parts 26*a*, 26*b* of a lateral wall 26, no space is created between an upper edge 26*as* of the lower part 26*a* and a lower edge 26*bi* of the upper part 26*b* of the relevant lateral wall 26, at the very least for angular positions between the aligned configuration and the useful tilted configuration. It follows that, beyond a useful configuration, this covering may no longer exist. However, it is considered that unforeseen usage of the packaging is made.

In the region of the opposite extension or opposite extensions, it can be provided that the upper part 26*b* of the lateral wall 26 is arranged transversally towards the internal of the drawer 10 relative to the lower part 26*a* of the relevant lateral wall. Such an arrangement prevents the lower edge 26*bi* of the upper part 26*b* from interfering with the case 12 when the drawer 10 is returned by sliding longitudinal downwards in its retracted position.

However, an inverse arrangement can also be provided with, in the region of the opposite extension or opposite extensions, the upper part 26*b* of the lateral wall arranged transversally towards the exterior of the drawer relative to the lower part 26*a* of the relevant lateral wall 26. This arrangement prevents the lower edge 26*bi* of the upper part 26*b* coming into contact with the products contained in the drawer during toggling movements of the upper portion of the drawer. This prevents this lower edge 26*bi* from being able to damage the products, especially by shearing.

In the example illustrated, covering of the two lower 26*a* and upper 26*b* parts of a relevant lateral wall 26 can be achieved as follows.

For example, the blank 16 illustrated in FIG. 1A can comprise two first lower lateral panels 261 each articulated respectively, by a pre-marked longitudinal fold line, to one of the two opposite longitudinal edges 200*a* of the lower part 180*a* of the rear panel. Simple folding back of the lower lateral panels 261 can form the lower parts 26*a* of the lateral walls 26. It is noted that the upper edge 263 of these first lower lateral panels extends longitudinally beyond the level of the axis A1, so as to form the extension 26*ap*. Here it is seen that the extension 26*ap* is created with continuity of material in the relevant lower lateral panel. But it could be provided that the extension is formed by an attached piece.

Two upper lateral panels 262 can also be provided which are each articulated respectively, by a pre-marked longitudinal fold line, to one of the two longitudinal edges 283 opposite of the upper transversal panel 281. In this embodiment, these two upper lateral panels 262 form the upper parts 26*b* of the lateral walls 26, after folding at 90° of the upper transversal panel 281 around the transversal edge 120, and after folding at 90° of the upper lateral panels 262 around the longitudinal edges 283 of the upper transversal panel 281. It is seen that by this double folding around two pre-marked folding lines which are oriented at 90° to each other, this shifts from a configuration in which, in the flat blank 16, the upper lateral panels 262 exhibit their largest dimension oriented transversally, to a configuration, after three-dimensional forming of the drawer by the double folding, in which the same upper lateral panels 262 exhibit their largest dimension oriented longitudinally.

In the example illustrated, in the flat blank 16, the upper lateral panels 262 exhibit a dimension according to the transversal direction which is greater than the longitudinal dimension of the upper part 180*b* of the rear panel 180. After three-dimensional forming, this characteristic lets the upper part 26*b* of the lateral wall 26, formed in this way by the corresponding upper lateral panel 262, extend longitudinally towards the lower part of the lateral wall beyond the axis of articulation A1. It is also evident that the upper lateral panels 262 have free end edges, opposite the longitudinal edges 283, which in this embodiment are in an arc of a circle. These free end edges form, after three-dimensional forming of the drawer, the lower edges 26*b*1 of the upper part 26*b* of the corresponding lateral wall. It is evident here that the extension 26*pp* is made with continuity of material in the relevant upper lateral panel.

If at the same time, as in the example illustrated, the first lower lateral panels 261 extend longitudinally towards the upper part 180*b* of the rear panel beyond the pre-marked transversal fold line 360 of articulation between the two parts of the rear panel, the characteristic mentioned earlier recurs of having surfaces covering the two parts 26*a* and 26*b* of a lateral wall 26 which are distributed on each side of the axis A1.

Advantageously, in the example illustrated, it is provided that, for each lateral wall 26, the lower part 26*a* of the lateral wall has a structure having two parallel panels, respectively internal and external. With such an arrangement, it is advantageously provided that at least one lower end 26*bi* of the upper part 26*b* of the lateral wall 26 is received with the possibility of sliding between the internal panel and the external panel for all configurations of the two portions of the drawer between the aligned configuration and the useful tilted configuration of the drawer 10.

For this it is evident that the side 16 comprises two second lower lateral panels 265 which are each articulated respectively, by a pre-marked longitudinal fold line, to a lower transversal edge 264 of one of the first lower lateral panels. In the flat blank 16, the second lower lateral panels 265 therefore extend longitudinally downwards relative to the first longitudinal panels. However, during the three-dimensional forming of the drawer 10, the second lower lateral panels 265 are folded back at 180° around the corresponding lower transversal edge 264 for be parallel and by covering with the first lower lateral panels 261. This folding of the second lower lateral panels 265 could be made towards the inside relative to the first lower lateral panels 261. But in a preferred embodiment these second lower lateral panels 265 are folded back towards the outside relative to the first lower lateral panels 261. The second lower lateral panels 265 have end edges 266 which, after folding at 180° of these panels, become upper edges 26*as* for the lower part 26*a* of the lateral walls 26. In the example illustrated, after folding at 180° during forming of the drawer 10, the end edges 266 of the second lower lateral panels 265 extend substantially at the same height according to the longitudinal direction as the upper edges 263 of the first lower lateral panels 261. In this case, these two edges 263 and 266 can jointly form the upper edge 26*as* of the lower part 26*a* of the lateral wall 26. However, as a variant, an offset could be provided between these two edges, including in the longitudinal direction. The second lower lateral panels exhibit a dimension according to the longitudinal direction, measured between the lower transversal edge 264 and the end edge 266, which is greater than the longitudinal dimension of the lower part 180*a* of the rear panel 180.

This gives the preferred construction of the invention in which the lower end of the upper part 26*b* of each lateral wall of the drawer is received interleaved and sandwiched between the upper ends of an internal panel and an external panel forming part of the lower part 26*a* of the corresponding lateral wall. In this way, the lower edge 26*b*1 of the upper part 26*b* of the lateral wall is not likely either to interfere with the case during sliding of the drawer between its retracted position and its extended position, or likely to interfere with the products contained in the drawer during toggling of the upper portion of the drawer.

In the embodiment, it is seen that the pre-cut blank 16 intended to form the drawer 10 comprises two lateral flaps 40 each articulated respectively by a pre-marked longitudinal fold line to one of the two opposite longitudinal edges 200*b* of the upper part 180*b* of the rear panel 180. It is seen that the first lower lateral panels 261 are each separated from the corresponding lateral flaps 40 by a cut-out line, which therefore corresponds to the upper edge 263 of the first lower lateral panels 261, and which overruns longitudinally beyond the level of the pre-marked transversal articulation fold line 360 between the two parts 180*a*, 180*b* of the rear panel 180. The flaps 40 are intended to be folded at 90° around the longitudinal edges 200*b* and each be assembled, for example by adhesion, with the corresponding upper lateral panel 262 to ensure three-dimensional forming of the drawer 10. In this way, for each lateral wall 26 each flap 40 forms an excess thickness delimited downwards by a lower edge, in this case the lower edge of the lateral flap 40 which corresponds to the upper edge 263 of the first lower lateral panel 261 belonging to the same lateral wall. After three-dimensional forming of the drawer, the first lower lateral panel 261 of a lateral wall is preferably substantially aligned in the same plane as the corresponding lateral flap 40. As the two edges opposite these two panels come from the same cut-out, in aligned configuration of the two portions of the drawer, the lower edge of the lateral flap 40 stops against the upper edge 263 of the first lower lateral panel 261 of the lower part 26*a* of the relevant lateral wall. This stop prevents the upper portion of the drawer 10 from tilting to the front around the transversal axis A1 relative to the lower portion of this drawer.

The lateral flaps 40 have longitudinal free external edges. In a variant of the invention, the blank 16 could be constructed with the upper lateral panels attached not to the upper transversal panel, but to these lateral flaps, along the longitudinal external edge. Of course, the upper lateral panels would be oriented, in the flat blank 16, prior to three-dimensional forming, with their large direction in the longitudinal direction.

The invention is not limited to the examples described and illustrated, as various modifications can be made without departing from its scope.

The invention claimed is:

1. A drawer for packaging (14) comprising a case (12) and a drawer (10), the drawer (10) being obtained from at least one pre-cut blank (16) of a sheet of material, of the type wherein:

the drawer (10) comprises a rear wall (18) delimited transversally by opposite rear longitudinal edges (20), and two opposite lateral walls (26) extending perpendicularly to the rear wall (18), each respectively along one of the rear longitudinal edges (20) of the rear wall;

the drawer (10) comprises an upper portion, comprising an upper part (18*b*) of the rear wall and upper parts (26*b*) of the two lateral walls (26), and a lower portion, comprising a lower part (18*a*) of the rear wall and lower parts (26*a*) of the two lateral walls (26);

the lower portion and the upper portion of the drawer are articulated to each other by a articulation (36) which has a transversal articulation axis (A1) and which connects the lower part (18*a*) and the upper part (18*b*) of the rear wall, the lower part (26*a*) and the upper part (26*b*) of the same lateral wall (26) of the drawer being disjointed to allow toggling of the upper portion of the drawer relative to the lower portion of the drawer around the transversal articulation axis (A1) between an aligned configuration in which the lower part (18*a*) and the upper part (18*b*) of the rear wall are coplanar, and at least one useful tilted configuration in which the lower part (18*a*) and the upper part (18*b*) of the rear wall form a nonzero angle, characterized in that each one of the lower part (26*a*) and the upper part (26*b*) of each lateral wall has an extension (26*ap*, 26*bp*) which extends longitudinally towards the other part beyond the transversal articulation axis (A1) such that each extension (26*ap*, 26*bp*) extends parallel to and faces the other part (26*b*, 26*a*) of the lateral wall for all the configurations of the two portions of the drawer between the aligned configuration and the useful tilted configuration of the drawer.

2. The drawer according to claim 1, characterized in that, for a relevant lateral wall (26), in the region of the extension opposite (26*ap*, 26*bp*), the upper part (26*b*) of the lateral wall is arranged transversally towards the exterior of the drawer relative to the lower part (26*a*) of the relevant lateral wall.

3. The drawer according to claim 1, characterized in that, for a relevant lateral wall (26), the lower part (26*a*) of the lateral wall has a structure having two parallel panels (261, 265), respectively internal and external, and in that at least one lower end (26*bi*) of the upper part (26*b*) of the lateral wall is received with the possibility of sliding between the internal panel (261) and the external panel (265) of the lower part (26*b*) for all configurations of the two portions of the drawer between the aligned configuration and the useful tilted configuration of the drawer.

4. The drawer according to claim 3, characterized in that, for a relevant lateral wall (26), the two parallel panels (261, 265) of the lower part (26*a*) of the lateral wall each comprise an extension (263, 266) which extends longitudinally towards the upper part beyond the transversal articulation axis (A1), and in that, for said relevant lateral wall, the upper part (26*b*) of the lateral wall comprises an extension (26*bi*) which is received with the possibility of sliding between the extensions (263, 266) of the two internal (261) and external (265) panels of the lower part (26*a*) of the lateral wall for all the configurations of the two portions of the drawer between the aligned configuration and the useful tilted configuration of the drawer.

5. The drawer according to claim 1, characterized in that, for at least one of the two lateral walls (26), the upper part (26*b*) of the lateral wall has an excess thickness (40) delimited downwards by a lower edge which, in aligned configuration of the two portions of the drawer, comes to stop against an upper edge (263) of the lower part (26*a*) of the relevant lateral wall.

6. The drawer according to claim 1, characterized in that it comprises an upper wall (28) which extends perpendicularly to the longitudinal direction in the region of an upper transversal edge (22) of the upper part (18*a*) of the rear wall (18) of the drawer.

7. The drawer according to claim 1, characterized in that it comprises a front wall (34) which is connected to longitudinal front edges of the lower part (26*a*) of each of the lateral walls (26).

8. The drawer according to claim 1, characterized in that it is made in a single piece from a single blank (16) of cardboard whereof the grammage is greater than or equal to 180 g/m2, and less than or equal to 2000 g/m2.

9. Packaging comprising a case (12) and a drawer (10), of the type wherein:

the case (12) comprises four opposite panels (13, 15, 17) in pairs and connected in pairs along four parallel longitudinal edges (21, 23) such that the case delimits an internal space (E) which extends longitudinally and which has a closed quadrilateral transversal cross-section;

the case (12) is open at at least one upper longitudinal end;

the drawer (10) has a transversal cross-section complementary to that of the internal space (E) of the case (12) so it can be guided by sliding longitudinally inside the case between at least one retracted position and an extended position;

characterized in that the drawer (10) is according to claim 1.

* * * * *